United States Patent [19]

Yamada et al.

[11] Patent Number: 4,839,273

[45] Date of Patent: Jun. 13, 1989

[54] PROCESS FOR THE DEVELOPMENT OF SILVER HALIDE PHOTOGRAPHIC MATERIAL

[75] Inventors: Minoru Yamada; Takashi Toyoda; Kunio Seto, all of Kanagawa, Japan

[73] Assignee: Fuji Photo Film Co., Ltd., Kanagawa, Japan

[21] Appl. No.: 103,874

[22] Filed: Oct. 2, 1987

[30] Foreign Application Priority Data

Oct. 2, 1986 [JP] Japan ..... 61-233295

[51] Int. Cl.[4] ..... G03C 1/02; G03C 5/24; G03C 5/38; G03C 11/00

[52] U.S. Cl. ..... 430/634; 430/399; 430/400; 430/421; 430/428; 430/430; 430/450; 430/460; 430/463; 430/464

[58] Field of Search ..... 430/450, 463, 460, 464, 430/421, 428, 430, 399, 400, 634

[56] References Cited

U.S. PATENT DOCUMENTS 3,025,779 3/1962 Russell et al. ..... 95/94
3,545,971 12/1970 Barnes et al. ..... 430/355
4,672,025 6/1987 Yamada et al. ..... 430/420

FOREIGN PATENT DOCUMENTS 0248450 12/1987 European Pat. Off. .
0263939 12/1985 Japan .
0263940 12/1985 Japan .

*Primary Examiner*—Mukund J. Shah
*Attorney, Agent, or Firm*—Sughrue, Mion, Zinn, Macpeak & Seas

[57] ABSTRACT

In a process for development, fixing, and washing or stabilization of a silver halide photographic light-sensitive material by means of an automatic developing machine, is provided, which process comprises supplying to a developing bath and/or a fixing bath a concentrated developing solution and/or a concentrated solution having a fixing capacity, respectively, and water which has been treated by at least one antifungal means selected from the group consisting of irradiation with ultraviolet rays, irradiation with magnetic fields, processing with ion exchange resins, and incorporation of at least one compound selected from the group consisting of aminopolycarboxylic acids and phosphonic acids. In a preferred embodiment, the amount of wash water or stabilizing solution to be refilled is 1 or less (including 0) per 1 $m^2$ of light-sensitive material, and the water processed by antifungal means contained in the stock tank is also used as the wash water or stabilizing solution.

14 Claims, 1 Drawing Sheet

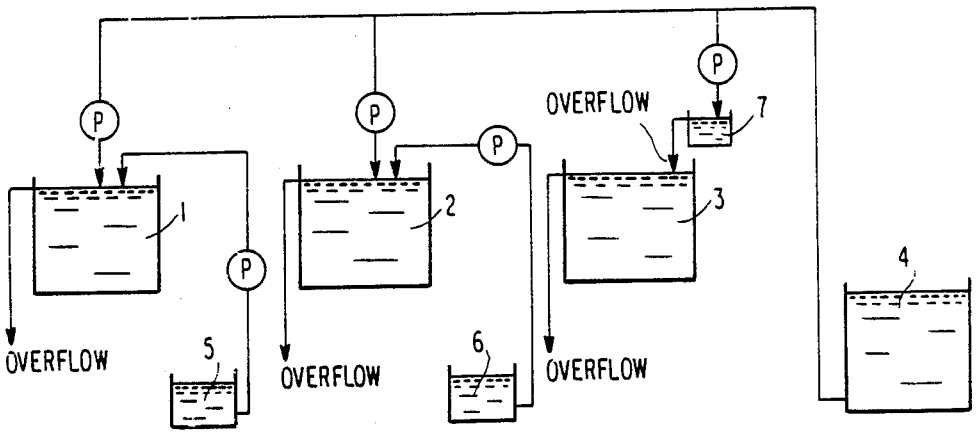
P
P
P
P
P
OVERFLOW
7
1
2
3
4
5
6
OVERFLOW
OVERFLOW
OVERFLOW

PROCESS FOR THE DEVELOPMENT OF SILVER HALIDE PHOTOGRAPHIC MATERIAL

FIELD OF THE INVENTION

The present invention relates to a process for the development of a silver halide photographic material by means of an automatic development machine.

BACKGROUND OF THE INVENTION

In the process for the development or fixation (or blix) of a silver halide photographic material by means of an automatic developing machine, the processing solutions are generally supplied in the form of a plurality of component chemical solutions for making stock solutions, so that the chemicals in the stock solutions will not adversely affect each other before use. In operation, these component chemical solutions are manually or automatically mixed with each other, diluted with water, and then stored as a developing solution or a fixing solution in the respective stock tanks provided in an automatic developing machine. As a light-sensitive material is processed, the diluted processing solutions are directly supplied to the light-sensitive material. However, the process of mixing a plurality of component chemical solutions, diluting the mixture with water, and putting the solutions into stock tanks is a complicated job that takes much time. Furthermore, since the processing solutions are stored in diluted form, the volume of the stock tanks must be large, requiring a great deal of installation space. Further, because the diluted processing solutions are subject to deterioration due to oxidation, their storage time in the stock tanks is limited. Therefore, such diluted processing solutions are disadvantageous in that they must be renewed within a specified period of time to maintain their initial photographic properties.

In order to eliminate one of the disadvantages of having a plurality of component chemical solutions, a method is known which comprises decreasing the number of component chemical solutions, e.g. stock solutions for processing solutions, to only one concentrated chemical solution to save mixing time. However, such a single concentrated chemical solution must still be diluted with water as in the case of using a plurality of component chemical solutions. Therefore, such a single concentrated chemical solution in installation still requires a great deal of space for the diluted stock solution and deterioration due to oxidation while being stored in the diluted form in a stock tank provided in an automatic developing machine still occurs.

On the other hand, another method is known which comprises mixing the concentrated stock solution for the processing solution with water shortly before use and supplying it to the processing bath instead of previously diluting the concentrated stock solution with water and storing it in the stock tank. In this method, however, it is necessary to supply fresh water as diluting water to the processing solutions so that the photographic properties and finish are not adversely affected. Therefore, plumbing apparatus must be provided to introduce tap water directly into the automatic developing machine. This restricts the installation choices for the automatic developing machine. Furthermore, even if diluting water is stored in a stock tank provided in the automatic developing machine, it must be very frequently renewed to maintain its freshness or the stock tank must be kept clean.

In washing or stabilization to be effected after development and fixing (or blix) of a silver halide photographic material, a technique is known which comprises incorporating various antifungal agents into the wash water or stabilizing solution to inhibit formation of mineral deposit. In particular, the use of such antifungal agents is very important in view of the demand in recent years for environmental protection, energy saving and speedy processing. This requires saving water by methods such as washing with pool water and washing with an extremely small amount of replenish water. However, if such wash water or stabilizing solution is used also as diluting water for the developing solution or fixing solution, the antifungal agent contained in the wash water can deteriorate the stability of the developing solution or fixing solution, adversely affect the photographic properties, or inhibit the film hardening reaction by aluminum in the fixing solution. Therefore, at least two kinds of water are necessary: wash water (or stabilizing solution) and diluting water. This is a very complicated job that requires a large installation space and considerable plumbing apparatus for introduction of tap water into the automatic developing machine. This is a great restriction that makes it impossible to operate the automatic developing machine any time and any place.

SUMMARY OF THE INVENTION

It is therefore an object of the present invention to provide a process for the development of a silver halide photographic material which does not require complicated jobs such as preparation of developing solution or fixing solution, renewal of diluting water, and cleaning of stock tanks; provides a developing solution or fixing solution having excellent stability, and eliminates the necessity for plumbing fixtures or a large installation space for an automatic developing machine, giving no installation restrictions.

It is another object of the present invention to provide a process for the development of a silver halide photographic material which enables water saving such as pool water washing and washing with an extremely small amount of water even when only a single tank is commonly used for wash water or a stabilizing solution, as diluting water for a developing solution and/or fixing solution and provides excellent stability of the developing solution or fixing solution and excellent photographic properties.

These and other objects of the present invention will become more apparent from the following detailed description and examples.

These objects of the present invention have been accomplished by a process for development of a silver halide photographic material comprising development, fixing, and washing or stabilization of a silver halide photographic light-sensitive material by means of an automatic developing machine, which process comprises supplying to a developing bath and/or a fixing bath a concentrated developing solution and/or a concentrated solution having a fixing capacity respectively, and water which has been treated by at least one antifungal means selected from the group consisting of irradiation with ultraviolet rays, irradiation with magnetic fields, processing with ion exchange resins, and incorporation of at least one compound selected from the group consisting of aminopolycarboxylic acids and phosphonic acids.

The objects of the present invention are further accomplished by the above described process further comprising additionally washing or stabilizing said silver halide photographic light-sensitive material with said water treated with antifungal means or with a combination of said water treated with antifungal means and wash water or stabilizing solution used is 3 l or less (including 0 l per 1 $m^2$ of said silver halide photographic light-sensitive material.

BRIEF DESCRIPTION OF THE DRAWING

The figure shows one embodiment of an automatic developing system for effecting the present process.

1 represents a developing tank.
2 represents a fixing tank.
3 represents a washing tank.
4 represents a water stock tank.
5 represents a concentrated developing solution stock tank.
6 represents a concentrated fixing solution stock tank.
7 represents a squeeze roller washing tank.
p represents a pump

DETAILED DESCRIPTION OF THE INVENTION

As antifungal means for the present invention there may be used irradiation with ultraviolet rays, irradiation with magnetic fields, ion exchange, and addition of specific compounds. These means can be used, singly or in combination. A preferred means among these means is addition of specific compounds.

The addition of such a specific compound can effectively achieve the stability, antifungal property, and precipitation preventing property of each processing solutions.

One of the processes for the application of an antifungal effect to washing water is passing the washing water through magnetic fields. In this process, washing water and diluting water are allowed to pass through magnetic fields between the positive and negative poles.

The magnetic field to be used in the present invention can be obtained by the use of a permanent magnet comprising a ferromagnet such as iron, cobalt, and nickel, or by passing a direct current through a coil or the like. However, the present invention is not specifically limited to these methods. All means for generating magnetic fields can be used in the present invention. In the present invention, a single magnet can be used to produce magnetic lines of force. Alternatively, two magnets (positive and negative poles) can be placed opposed to each other to produce magnetic lines of force therebetween.

The passing of washing water and diluting water to be used in the present invention through magnetic fields can be accomplished by moving (or rotating) a permanent magnet provided in a water stock tank and/or outside the liquid system or stirring or circulating water relative to the magnetic field. A particularly preferred method is to circulate water in a circulating pipe having a permanent magnet fixed to a part or an entire part of the inner portion or outer portion thereof.

The irradiation of washing water and diluting water with ultraviolet rays in the present invention can be accomplished with a commercially available ultraviolet lamp, ultraviolet radiating apparatus, or the like. Preferably, the output of such an ultraviolet lamp is 5 to 800 W (tube output). However, the present invention is not limited to these arrangements. In accordance with a preferred embodiment of the present invention, the wavelength of ultraviolet rays to be used is in the range of 220 to 350 nm.

The processing with ion exchange resins in the present invention involves passing water through a mixed bed column filled with a commercially available H-type strong acid cation exchange resin and OH-type strong base exchange resin so that calcium or magnesium ions are remarkably removed therefrom. A method equivalent to this process is to use distilled water as washing water and diluting water to be used in the present invention.

Examples of the process for irradiation with ultraviolet rays are described in Japanese Patent Application (OPI) No. 263939/85 (the term "OPI" as used herein means an "unexamined published application"). Examples of the process for passing through a magnetic field are described in Japanese Patent Application (OPI) No. 263940/85. Examples of the process for passing through ion exchange resins are described in Japanese Patent Application No. 131632/86.

Addition of specific compounds includes addition of aminopolycarboxylic acids and phosphonic acid.

Specific examples of aminopolycarboxylic acids which can be used in the present invention include ethylenediamine tetraacetic acid (EDTA), diethylenetriamine pentaacetic acid, ethylenediamine-N-(β-oxyethyl)-N,N',N'-triacetic acid, propylenediamine tetraacetic acid, nitrilo triacetic acid, cyclohexanediamine tetraacetic acid, imino diacetic acid, alkylimino diacetic acid, dihydroxyethyl glycine, ethyletherdiamine tetraacetic acid, glycoletherdiamine tetraacetic acid, ethylenediamine tetrapropionic acid, phenylenediamine tetraacetic acid, 1,3-diamino-2-propanol tetraacetic acid, triethylenetetramine hexaacetic acid, hydroxyethyliminoacetic acid, oxybis(ethyleneoxynitrilo)tetraacetic acid, malic acid, and sodium or potassium salts thereof.

Specific examples of phosphonic acids which can be used in the present invention include compounds of the following general formulae (I) to (IV):

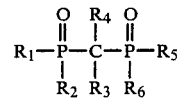

(I)

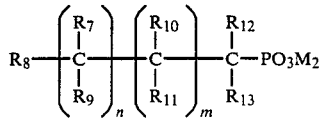

(II)

m = 0 or 1
n = 0 or 1

$$R_{14}N(CH_2PO_3M_2)_2 \quad \text{(III)}$$

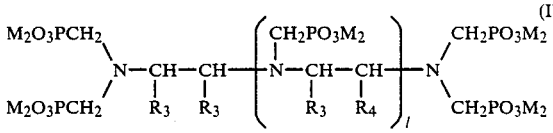

(IV)

l = 0, 1, 2 wherein $R_1$ to $R_6$ each represents a hydrogen atom, a hydroxyl group, a $C_{1-3}$ alkyl group such as a methyl group, an ethyl group, and a propyl group, an amino group, a $C_{1-3}$ alkoxy group such as a methoxy group, and an ethoxy group, an alkylamino group preferably containing 1 to 3 carbon atoms, an arylamino group preferably containing 6 to 8 carbon atoms, or an aryloxy group preferably containing 6 to 8 carbon atoms; $R_7$ to $R_{13}$ each represents a hydrogen atom, a hydroxyl group, -COOM, $-PO_3M_2$ wherein M represents an alkali metal such as a sodium atom or a potassium atom, or a $C_{1-3}$ alkyl group such as a methyl group, an ethyl group, and a propyl group; $R_{14}$ represents a hydrogen atom, or a $C_{1-3}$ alkyl group such as a methyl group, an ethyl group, and a propyl group.

Specific examples of compounds of the general formulae (I) to (VI) include the following compounds:

Compound (1)

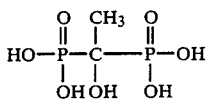

Compound (2)

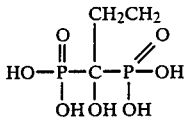

Compound (3)

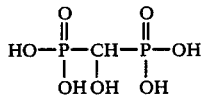

Compound (4)

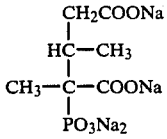

Compound (5)

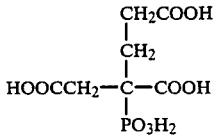

Compound (6)

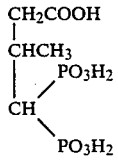

Compound (7)

-continued

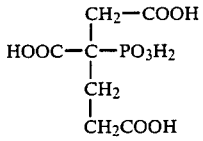

Compound (8)

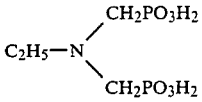

Compound (9)

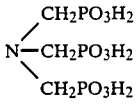

Compound (10)

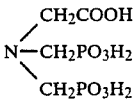

Compound (11)

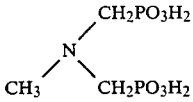

Compound (12)

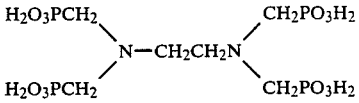

Compound (13)

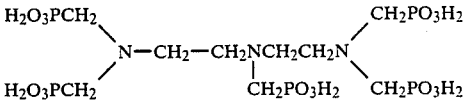

These compounds are preferably added in the form of sodium salts and/or potassium salts.

Particularly preferred among these compounds are ethylenediamine tetraacetic acid (EDTA), diethylenetriamine pentaacetic acid, ethylenediamine-N-hydroxyethyl- N,N',N'-triacetic acid, propylenediamine tetraacetic acid, triethylenetetramine hexaacetic acid and other aminopolycarboxylic acids, ethylenediamine-tetramethylenephosphonic acid, 1-hydroxyethylidene-1,1-diphosphonic acid, and sodium, potassium, and ammonium salts thereof.

Diluting water for conditioning the solution in the stock tank to be used in the present invention can serve well with only one of these compounds. However, these compounds may be used in combination.

The respective compound is preferably used in an amount of 0.02 to 20 g, particularly 0.05 to 5 g per 1 l of diluting water.

The above described aminopolycarboxylic acids and phosphonic acids are generally known as so-called metal chelating agents. Therefore, it is well known from L. F. Mason, *Photographic Processing Chemistry,* (Focal Library 1975) that these compounds are used in photographic developing solutions to block Ca and Mg ions in water. It is also well known that these compounds are used as chelating agents in a fixing solution. However, there is no teaching that water containing these compounds is used as diluting water for a developing solution or fixing solution.

Water which has been processed for an antifungal effect in accordance with the present invention is used as diluting conditioning water for at least one of the developing solution and fixing solution.

As suitable concentrated developing solutions and concentrated fixing solutions for the present invention there can be used any suitable processing solutions known in the art. A plurality of component chemical solutions each may be stored in respective stock solution tanks in an automatic developing machine so that they can be automatically mixed with each other at the same time with or before and after the present diluting water. Alternatively, a single agent solution may be used. A single agent solution is preferably used rather than a component chemical solution from the standpoint of simplification of apparatus. From this standpoint, the present process is better applied to black-and-white developing solutions and fixing solutions than to color developing solutions and blix solutions.

The concentration degree of such concentrated solutions is not specifically limited but is preferably in the range of 1.5 to 8 times.

When the water of the processing solution enclosed in the tank in the automatic developing machine is vapored and reduced, the amount of the lost water can be supplied with the water which has been processed for an antifungal effect. In this case, the amount of the lost water may be sensed and supplied by using a level sensor.

The developing agent for black-and-white developing solutions to be used in the present invention is not specifically limited. For example, dihydroxybenzenes such as hydroquinone, 3-pyrazolidones such as 1-phenyl-3-pyrazolidone, aminophenols such as N-methyl-p-aminophenol, and other known developing agents can be used, singly or in combination. Preferably, dihydroxybenzenes are used because excellent properties can be easily obtained. Alternatively, combinations of dihydroxybenzenes and 1- phenyl-3-pyrazolidones or combinations of dihydroxybenzenes and p-aminophenols can be used.

Examples of dihydroxybenzenes developing agents which can be used in the present invention include hydroquinone, chlorohydroquinone, bromohydroquinone, isopropylhydroquinone, methylhydroquinone, 2,3-dichlorohydroquinone, 2,3-dibromohydroquinone, and 2,5-dimethylhydroquinone. Particularly preferred among these compounds is hydroquinone.

Examples of 1-phenyl-3-pyrazolidone or derivatives thereof which can be used as developing agents in the present invention include 1-phenyl-4,4-dimethyl-3-pyrazolidone, 1-phenyl-4-methyl-4-hydroxymethyl-3-pyrazolidone, 1-phenyl-4,4-dihyroxymehyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

Examples of p-aminophenyl developing agents which can be used in the present invention include N-methyl-p-aminophenol, p-aminophenol, N-(β-hydroxyethyl)-p-aminophenol, N-(4-hydoxyphenyl) glycine, 2-methyl-p-aminophenol, and p-benzylaminophenol. Particularly preferred among these compounds is N-methyl-p-aminophenol.

The color developing solution to be used in the development processing of the present invention is preferably an alkaline aqueous solution. As color developing agents, p-phenylenediamine type compounds are preferably used rather than aminophenol type compounds. Typical examples of p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, a sulfate thereof, a hydrochloride thereof, and a p-toluenesulfonate thereof. These compounds may be used in combination with wach other depending on the purpose.

The present developing agent is preferably used in an amount of 0.01 to 0.08 mol/l. If a combination of dihydroxybenzenes and 1-phenyl-3-pyrazolidone or p-aminophenols is used, the amounts of the former combination and the latter combination to be used are 0.01 to 0.5 mol/l and 0.06 mol/l or less, respectively.

Examples of sulfites which can be used as preservatives in the present invention include sodium sulfite, potassium sulfite, lithium sulfite, ammonium sulfite, sodium bisulfite, potassium metabisulfite, and sodium formaldehyde bisulfite. The amount of such a sulfite to be used is in the range of 0.2 mol/l to 2.5 mol/l, preferably 0.4 mol/l to 2.5 mol/l.

The pH value of the developing solution to be used in the present invention is preferably in the range of 9 to 13.

Examples of alkali agents for adjusting the pH of the present developing solution include sodium hydroxide, potassium hydroxide, sodium carbonate, potassium carbonate, tribasic sodium phosphate, tribasic potassium phosphate, and other pH adjustors.

Buffers such as borates as described in Japanese Patent Application No. 28708/86, saccharose, acetoxime, and 5-sulfosalicylic acid as described in Japanese Patent Application (OPI) No. 93433/85, phosphates, and carbonates can be used.

Examples of other additives which can be used in the present invention include development inhibitors such as sodium bromide, potassium bromide, and potassium iodide, organic solvents such as ethylene glycol, diethylene glycol, triethylene glycol, dimethyl formamide, methyl cellosolve, hexylene glycol, ethanol, and methanol, and fog inhibitors or blackpepper inhibitors such as mercapto compounds (e.g. 1-phenyl-5-mercaptotetrazole, and sodium 2-mercaptobenzimidazole-5-sulfonate), indazole compounds (e.g. 5-nitroindazole), and benztriazole compounds (e.g. 5-methylbenztiazole). If necessary, the present developing solution may further contain a color toner, surface active agent, defoaming agent, water hardener, film hardener such as glutaraldehyde, or amino compound as described in Japanese Patent Application (OPI) No. 106244/81.

In the present invention, a silver contamination inhibitor such as described in Japanese Patent Application (OPI) No. 24347/81 can be used.

The present developing agent may comprise an amino compound such as an alkanolamine described in Japanese Patent Application (OPI) No. 106244/81.

Furthermore, if the developing agent is previously incorporated in the light-sensitive material, the present development process may be replaced by an alkali activation process.

The alkali activating solution to be used in the alkali activation process can contain any suitable components other than developing agents used in ordinary black-and-white developing solutions. The pH value of such an alkali activation solution is normally about 10 to 14, preferably about 11 to 14.

Alternatively, compounds as described in L. F. A. Mason, *Photographic Processing Chemistry,* pp. 226–229 (Focal Press, 1966), U.S. Pat. Nos. 2,193,015, and 2,592,364, and Japanese Patent Application (OPI) No. 64933/73 can be used.

If the concentrated developing solution is supplied to an automatic developing machine together with diluting water as the light-sensitive material is processed in the automatic developing machine in accordance with the present process, the concentrated developing solution most preferably consists of a single agent from the standpoint of simplification of the machine and accuracy of supply. However, a concentrated developing solution consisting of two agents may be diluted with water. If such a concentrated developing solution consisting of two agents is used, the present process can be accomplished with an arrangement such that a sufficient number of pumps is used or a packing material designed to separate the two agents shortly before use is employed so that the two agents can be thoroughly mixed with each other when used. In this arrangement, the two agents can be supplied in substantially the same manner as in the case of a single agent solution.

If the concentrated developing solution contains a development film hardener, the unstability of the development film hardener makes it substantially impossible to prepare a single-agent developing solution. Therefore, the light-sensitive material needs to be hardened to an extent such that it needs no more hardened film. For example, a process as described in Japanese Patent Application (OPI) No. 111933/83 can be used.

Another requirement for the preparation of a single-agent concentrated developing solution is that if a 3-pyrazolidone developing agent is used, this agent must be stable enough to be insusceptible to hydrolysis in an alkali solution. In particular, 3-pyrazolidones which are di-substituted by methyl and/or hydroxymethyl in the 4-position are preferably used among the previously described 3-pyrazolidones.

The development temperature and time are in the range of about 20° C. to 50° C. and 10 seconds to 2 minutes, respectively.

Examples of solutions having a fixing capacity include fixing solution and blix solution.

Such a fixing solution is an aqueous solution containing a thiosulfate and optionally containing a water-soluble aluminum compound, acetic acid, and a dibasic acid (e.g., tartaric acid, citric acid, and salts thereof). The fixing solution has a pH value of 3.8 or more, preferably 4.0 to 5.5, particularly 4.65 to 5.5.

Examples of fixing agents include sodium thiosulfate and ammonium thiosulfate. The fixing agent should have thiosulfuric acid ions and ammonium ions as essential ingredients. Ammonium thiosulfate is preferably used in view of the fixing rate. The amount of the fixing agent used can be properly selected by the skilled artisan and is normally in the range of about 0.1 mol/l to about 5 mol/l.

A water-soluble aluminum salt which acts mainly as a film hardener in the fixing solution is a compound which is commonly known as a film hardener for acidic film hardening and fixing agents. Examples of such a compound include aluminum chloride, aluminum sulfate, and potassium alum.

These dibasic acid and/or citric acid compounds can be used, singly or in combination. These compounds are effective when contained in the fixing solution in an amount of 0.005 mol/l or more, preferably 0.01 to 0.03 mol/l.

Specific examples of the dibasic acid or a derivative thereof include tartaric acid, potassium tartrate, sodium tartrate, and potassium sodium tartrate.

Examples of citric acid derivatives useful in the present invention in addition to citric acid include sodium citrate, potassium citrate, lithium citrate, and ammonium citrate.

The present fixing solution can optionally comprise a preservative such as a sulfite and a bisulfite, a pH buffer such as acetic acid and boric acid, a pH adjustor such as sulfuric acid, a chelating agent having a water hardening capacity, or a compound as described in Japanese Patent Application No. 218562/85. Since the pH value of the developing solution is high, such a pH buffer is used in an amount of 10 to 40 g/l, preferably 18 to 25 g/l.

The fixing temperature and time are preferably in the range of about 20° C. to about 50° C. and 10 seconds to 2 minutes, respectively, as in the case of the development process.

If the concentrated fixing solution is supplied to an automatic developing machine together with diluting water as the light-sensitive material is processed in the automatic developing machine in accordance with the present process, the concentrated fixing solution most preferably consists of a single agent as in the case of the developing solution.

The stock solution of fixing solution is stable when the pH thereof is 4.5 or above, preferably 4.65 or above. If the fixing solution is allowed to stand for many years with a pH value of lower than 4.5 before use, thiosulfates contained therein are decomposed to sulfur. Therefore, if the pH is 4.5 or higher, there is less sulfite gas produced, providing a better working environment. The upper limit of the pH value is not so critical. However, if the fixing solution is used with too high a pH value, the pH of the film is kept too high even after being washed, giving a high film wettability which increases the dry load. Therefore, the upper limit of the pH value for practical purposes is about 7. If the fixing solution contains an aluminum salt to harden the film, the upper limit of the pH is set to 5.5 so that the precipitation of the aluminum slat is inhibited. When water containing the specific compound is used as a diluting water in accordance with the present invention, it is preferable that a fixing solution containing an aluminium hardening agent is not used.

Of course the present fixing solution may consist of two agents rather than a single agent. In this case, the present process can be accomplished by mechanical rearrangement, e.g., by increasing the number of pumps.

In the present invention, either the developing solution or the fixing solution may be a liquid requiring no diluting water.

The amount of the various concentrated solutions to be supplied to the processing solution and the mixing ratio of the various concentrated solutions to diluting water depend on the composition of the concentrated solutions. In general, the ratio of the concentrated solution to diluting water is 1:0.5 to 1:8. The total amount of the concentrated solution and diluting water is preferably 100 to 1,500 ml per 1 $m^2$ of the light-sensitive material.

In the present invention, the light-sensitive material is subjected to washing or stabilization after being developed and fixed.

Washing or stabilization can be accomplished by any suitable methods known in the art. Water containing various additives known in the art can be used as washing water or a stabilizing solution. The water which has been processed for an antifungal effect of the present invention may be incorporated into washing water or a stabilizing solution. Then, it enables water saving of up to 3 l per 1 $m^2$ of the light-sensitive material and also enables saving of stock tanks. In other words, both the conditioning diluting water for the developing solution and the solution having a fixing capacity and the washing water or the stabilizing solution can be supplied from a common stock tank, thereby providing a more compact automatic developing machine.

The combined use of water which has been processed with antifungal means (particularly, water which has been added a specific compounds) in accordance with the present process with washing water or stabilizing solution enables inhibition of the formation of mineral deposit, making it possible to save water by 0 to 3 l, preferably 0 to 2 l, more preferably 0 to 1 l per 1 $m^2$ of the light-sensitive material. Thus the amount of wash water or stabilizing solution refilled is 3 l or less (including 0 l) per 1 $m^2$ of light-sensitive material. An automatic developing machine can be installed anywhere without the necessity of piping works.

In the present invention, zero refilling means that refilling is not made at all except in the case where a decrease caused by natural evaporation of washing water in the washing water tank is replaced, i.e., a so-called "reservoir" processing requiring substantially no refilling is used.

As the process for minimizing the refilling amount there has heretofore been known a multistage countercurrent system (e.g., 2-stage and 3-stage system). The application of the multistage countercurrent system to the present invention allows the fixed light-sensitive material to be sequentially brought into contact with a processing solution which has not yet been contaminated by the fixing solution, making a more efficient washing possible. By this process, unstable thiosulfates or the like are properly removed, making the possibility of deterioration or discoloration less. Thus, a further remarkable stabilizing effect can be obtained. This process requires only a very little amount of washing water as compared to the prior art process.

For example, the prior art process requires washing water in an amount 200 to 2,000 times that of the fixing solution brought into the washing tank together with the light-sensitive material. The present process provides a sufficient effect by using washing water in an amount only 2 to 50 times that of the fixing solution brought over. Thus, the present process reduces the required amount of washing water to about 1/100 of that of the prior art process.

However, the present process is more effective particularly when a single washing tank is used.

The washing water (or stabilizing solution) may be a so-called "reservoir" water as described above. Alternatively, water which has been processed for antifungal effect in accordance with the present process may be gradually refilled as the light-sensitive material is processed.

In the present process, if a small amount of washing water is used, a squeeze roller washing tank as described in Japanese Patent Application No. 163217/86 is preferably used.

A part or entire amount of the overflow liquid from the washing or stabilizing bath caused by refilling water which has been processed for antifungal effect in accordance with the present process as the processing is in progress can be used in the processing solution having a fixing capability for the preceeding step as described in Japanese Patent Application (OPI) No. 235133/85. This enables the saving of the stock water. This also further reduces the amount of waste liquor.

The present invention is particularly advantageous to a roller conveyor type automatic developing machine.

The amount of the fixing solution brought by the light-sensitive material into the washing tank cannot be specifically determined but is normally in the range of 5 to 50 ml/$m^2$.

Water which has been processed with antifungal means in accordance with the present process and stored in a stock tank is preferably used commonly as diluting water for a stock processing solution such as a developing and fixing solution and washing water because less space is required. Alternatively, conditioning diluting water and washing water (or stabilizing solution) which have been processed for antifungal means in accordance with the present process can be stored in separate tanks.

If the diluting water and the washing water (or stabilizing solution) are stored in separate tanks, the washing water (or stabilizing bath) may contain various additives incorporated therein.

For example, a chelate compound having a stability of chelation with aluminum log K of 10 or more can be contained in the washing water or stabilizing bath. Such a chelate compound is effective in prevention of precipitation of aluminum compounds in the washing water.

Specific examples of such a chelating agent include ethylenediamine tetraacetic acid (log K=16.1), cyclohexanediamine tetraacetic acid (log K=17.6), diaminopropanol tetraacetic acid (log K=13.8), diethylenetriamine pentaacetic acid (log K=18.4), triethylenetetramine hexaacetic acid (log K=19.7), and sodium, potassium and ammonium salts thereof. The added amount of such a chelating agent is preferably in the range of 0.01 to 10 g/l, particularly 0.1 to 5 g/l.

The washing water to be used in the present invention may contain other various additives such as antibacterial agents for the purpose of preventing the generation of microorganisms.

Antibacterial agents, microbiocides and surface active agents as described in L. E. West, *Water Quality Criteria,* Photo. Scie. & Eng., Vol. 9, No. 6 (1965), M. W. Beach *Microbiological Growths in Motion-Picture Processing,* SMPTE Journal, Vol. 85, (1976), R. O. Deegan, *Photo Processing Wash Water Biocides,* J. Imaging Tech., Vol. 10, No. 6 (1984), and Japanese Patent Application (OPI) Nos. 8542/82, 58143/82, 105145/83, 132146/82, 18631/83, 97530/82, and 157244/82 can be used in combination.

The present washing bath can further contain as a microbiocide an isothiazoline compound as described in R. T. Kreiman, *J. Image Tech,* 10, (6), 242 (1984), *Research Disclosure,* Nos. 20526 (May, 1981), and 22845

(April, 1983), or a compound as described in Japanese Patent Application No. 51396/86.

Specific examples of antibacterial agents include phenol, 4-chlorophenol, pentachlorophenol, cresol, o-phenylphenol, chlorophene, dichlorophene, formaldehyde, glutaraldehyde, chloroacetamide, p-hydroxybenzoic ester, 2-(4-thiazolyl)benzimidazole, benzoisothiazoline-3-one, dodecyl-benzyl-dimethylammonium chloride, N-(fluorodichloromethylthio)-phthalimide, and 2,4,4'-trichloro-2'-hydroxydiphenylether.

Other examples of suitable antibacterial agents include compounds as described in, Hiroshi Horiguchi, *Bokin Bobai No Kagaku,* published by Sankyo Shuppan, 1982), and, *Bokin Bobai Gijutsu Handbook,* (edited by Nippon Bokin Bobai Gakkai, published by Gihodo, 1986).

Alternatively, a silver image stabilizer as described in Japanese Patent Application (OPI) Nos. 43452/83, 114035/83, and 83534/86 can be incorporated in the wash water.

The present wash water may further contain various surface active agents for the purpose of inhibiting uneven waterdrop. As such a surface active agent there can be used any one of cationic, anionic, nonionic, and amphoteric surface active agents. Specific examples of such a surface active agent include compounds as described in, *Handbook of Surface Active Agents,* (published by Kogaku Tosho K. K.).

The present process is particularly effective when the ordinary washing step is replaced by a multistage countercurrent stabilizing process (so-called stabilizing process) as described in Japanese Patent Application (OPI) No. 8543/82. In this case, the bleaching or fixing component in the final bath is preferably in the range of $5\times10^{-2}$ mol/l or less, particularly $1\times10^{-2}$ mol/l or less.

The above described stabilizing bath comprises various compounds for the purpose of stabilizing the image. For example, in order to adjust the pH value of the film (to e.g., 3 to 8), various buffers such as borate, metaborate, borax, phosphate, carbonate, potassium hydroxide, ammonia water, monocarboxylic acid, dicarboxylic acid, polycarboxylic acid, and combinations thereof, and aldehydes such as formaldehyde can be used. Other typical examples of such compounds include chelating agents, anti-bacterial agents such as thiazoles, isothiazoles, halogenated phenols, sulfonylamide, and benzotriazole, surface active agents, brightening agents, film hardeners, and other various additives. These same or different kinds of compounds can be used singly or in combination.

As a film pH adjustor for use in the processing machine there can be used various ammonium salts such as ammonium chloride, ammonium nitrate, ammonium sulfate, ammonium phosphate, ammonium sulfite, and ammonium thiosulfate. These ammonium salts improve the image stability.

Silver halide photographic materials to which the present process can be applied are various color and black-and-white light-sensitive materials. Examples of such light-sensitive materials include color negative films for general use or for use in motion pictures, color reversal films for use in slides or motion pictures (optionally free of couplers), color photographic paper, color positive films for use in motion pictures or the like, color reversal photographic paper, medical or industrial X-ray photographic materials, X-ray duplicate photographic materials, medical CRT image photographic materials, light-sensitive materials for graphic arts (such as scanner light-sensitive materials, light-sensitive materials for camera use, light-sensitive materials for line-work use, and light-sensitive materials for contact work), general black-and-white light-sensitive materials, and black-and-white photographic paper. The present invention can be particularly useful with black-and-white photographic light-sensitive materials.

In accordance with the present invention, the photographic light-sensitive material which has been developed, fixed, and washed is dried. The drying is normally effected at a temperature of about 40° C. to about 100° C. The drying time is properly selected depending on the ambient conditions but is normally between about 5 seconds and 3.5 minutes.

Roller conveyor type automatic developing machines are described in U.S. Pat. Nos. 3,025,779 and 3,545,971.

A pre-washing bath as described in Japanese Patent Application (OPI) No. 38465/87 may be provided.

The silver halide photographic material to which the present process can be applied comprises a support and at least one silver halide emulsion layer coated thereon. Of course the silver halide photographic material may optionally comprise a back layer, anti-halation layer, intermediate layer, and top layer (protective layer).

The silver halide emulsion is a dispersion of a silver halide such as silver chloride, silver iodide, silver bromide, silver chlorobromide, silver iodobromide, and silver chloroiodobromide in a hydrophilic colloid such as gelatin. The present silver halide emulsion can be prepared by mixing a water-soluble silver salt such as silver sulfate with a water-soluble halogen salt in the presence of water and a hydrophilic colloid by a suitable method well known in the art such as a single jet process, a double jet process, and a controlled jet process, and then subjecting the mixture to physical ripening and chemical ripening such as gold sensitizing and/or sulfur sensitizing.

A spectral sensitizer such as a cyanine dye, a melocyanine dye, and mixtures thereof, a stabilizer such as 4-hydroxy-6-methyl-1,3,3a,7-tetrazaindene, sensitizers such as compounds as described in U.S. Pat. No. 3,619,198, a fog inhibitor such as benzotriazole, 5-nitrobenzimidazole, and polyethyleneoxide, a film hardener such as formaldehyde, glyoxal, mucochloric acid, 2-hydroxy-4,6-dichloro-a-triazine, and N,N'-ethylenebis(vinylsulfonylacetamide), or a coating aid such as saponin, sodium lauryl sulfate, dodecylphenol-polyethyleneoxide ether, and hexadecyltrimethyl ammonium bromide can be added to the silver halide emulsion during its preparation or shortly before the latter is coated on a support. The silver halide emulsion thus prepared is coated on a support such as baryta paper, resin coated paper, cellulose acetate film, and polyethylene terephthalate film by a dip process, an air knife process, an extrusion doctor process, a double coating process, or the like, and then dried.

The silver halide emulsion to be used in the present invention can comprise a hydrazine derivative as described in, *Research Disclosure,* No. 23516, page 346, (November, 1983), U.S. Pat. Nos. 4,080,207, 4,269,727, 4,276,364, and 4,278,748, and Japanese Patent Application (OPI) No. 179734/85.

The present invention will be further illustrated in the following examples, but the present invention should not be construed as being limited thereto.

Unless otherwise specified, all percents, ratios, etc. are by weight.

EXAMPLE 1

(1) Preparation of silver halide emulsion

A proper amount of ammonia was put into a container containing gelatin, potassium bromide, and water which had been heated to a temperature of 55° C. An aqueous solution of silver nitrate and an aqueous solution of potassium bromide were added to the admixture by a double jet process while the pAg value in the container was kept at 7.60 to prepare a monodispersed emulsion of particulate silver bromide having an average particle size of 0.55 μm. The emulsion was then desalted. The pH value and pAg value of the emulsion were adjusted to 6.2 and 8.6, respectively. The emulsion thus processed was then subjected to gold and sulfur sensitizing with sodium thiosulfate and chloroauric acid to obtain desired photographic properties. The emulsion was measured by KubelkaMunk function method for 100 plane/111 plane ratio. The result was 98/2.

(2) Preparation of emulsion coating solution 11 g of the emulsion thus obtained was measured out. The emulsion was then heated to a temperature of 40° C. so that dissolution occurred. 70 cc of a methanol solution ($9\times10^{-4}$ mol/l) of a near infrared sensitizing dye of the structural formula A, an aqueous solution of 4-hydroxy-6-methyl-1,3,3a,7-tetrazaindene, an aqueous solution of a dodecylbenzenesulfonate as a coating aid, and an aqueous solution of a polypotassium-p-vinylbenzene sulfonate compound as a thickener were added to the emulsion to prepare an emulsion coating solution.

Structural Formula A

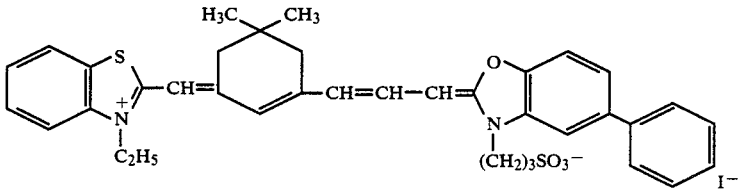

(3) Preparation of coating solution of surface protective layer for light-sensitive layer An aqueous solution of sodium polysulfonate, finely divided polymethylmethacrylate (average particle size: 3.0 μ) as a matting agent, N,N'-ethylenebis-(vinylsulfonylacetamide as a film hardener, an aqueous solution of sodium t-octylphenoxyethoxyethoxyethanesulfonate as a coating aid, a fluorine-containing surface active agent, and a nonionic surface active agent were added to a 10 wt % aqueous solution of gelatin which had been heated to a temperature of 40° C. to prepare a coating solution.

(4) Preparation of back coating solution

An aqueous solution of sodium polyethylenesulfonate as a thickener, an aqueous solution of a dye of the structural formula B, an aqueous solution of N,N'-ethylenebis-(vinylsulfonylacetamide) as a film hardener, and an aqueous solution of sodium t-octylphenoxyethoxyethoxyethanesulfonate as a coating aid were added to 1 kg of a 10 wt % aqueous solution of gelatin which had been heated to a temperature of 40° C.

Structural Formula B

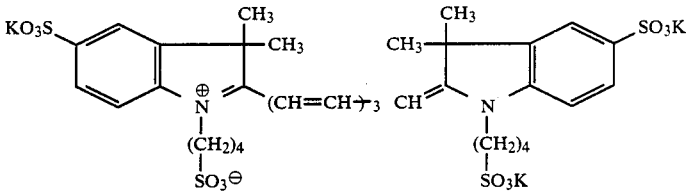

(5) Preparation of coating solution of surface protective layer for back layer An aqueous solution of sodium polyethylenesulfonate as a thickener, finely divided polymethylmethacrylate (average particle size: 3.0 μ) as a matting agent, an aqueous solution of sodium t-octylphenoxyethoxyethoxyethanesulfonate as a coating aid, a fluorine-containing surface active agent, and a nonionic surface active agent were added to a 10 wt % aqueous solution of gelatin which had been heated to a temperature of 40° C.

(6) Preparation of coated specimens

The above described back coating solution was coated on one side of a polyethyleneterephthalate support with the above described coating solution of surface protective layer for the back layer in an amount of 4 g/m² in terms of gelatin. The emulsion coating solution containing an infrared sensitizing dye and the coating solution of surface protective layer for the emulsion layer were subsequently coated on the other side of the support in an amount of 3.5 g/m² in terms of silver.

The film specimen thus obtained was subjected to development by means of a developing system shown in the figure and described hereinafter.

The composition of the developing solution and the fixing solution used were as follows:

| Concentrated Developing Solution | |
|---|---|
| Potassium hydroxide | 56.6 g |
| Sodium sulfite | 200 g |

-continued

| | |
|---|---|
| Diethylenetriamine penta-acetic acid | 6.7 g |
| Potassium carbonate | 16.7 g |
| Boric acid | 10 g |
| Hydroquinone | 83.3 g |
| Diethylene glycol | 40 g |
| 4-Hydroxymethyl-4-methyl-1-phenyl-3-pyrazolidone | 5.5 g |
| 5-Methylbenzotriazole | 2 g |
| Water to make | 1 l |
| pH | 10.30 |

Concentrated Fixing Solution

| | |
|---|---|
| Ammonium thiosulfate | 560 g |
| Sodium sulfite | 60 g |
| Disodium ethylenediamine tetraacetate (dihydrate) | 0.10 g |
| Sodium hydroxide | 24 g |
| Water to make | 1 l |
| Acetic acid to make | pH 5.10 |

Water Stock Tank Solution

| | |
|---|---|
| Disodium ethylenediamine tetraacetate (dihydrate) | 0.5 g/l |

Automatic Developing Machine (shown in the figure)

| (60-second dry-to-dry process) | | |
|---|---|---|
| Developing tank (1) | 6.5 l | 35° C. × 12 sec. |
| Fixing tank (2) | 6.5 l | 35° C. × 12 sec. |
| Washing tank (3) | 6.5 l | 20° C. × 7.5 sec. |
| Squeeze roller cleaning tank (7) | 200 ml | |
| Water stock tank (4) | 25 l | |

Before the development began, the tanks were filled with the following processing solutions:

Developing Tank 667 ml of water and 10 ml of an aqueous solution containing 2 g of potassium bromide and 1.8 g of acetic acid were added to 333 ml of the above described concentrated developing solution to prepare a developing solution of pH 10.15.

Fixing Tank 750 ml of water was added to 250 ml of the above described concentrated fixing solution.

Washing Tank and Cleaning Tank

Same as the above described water stock tank solution.

Every time one B4 size sheet (25.7 cm ×36.4 cm) of the above described light-sensitive material was processed, the developing tank was refilled with 20 ml of the concentrated developing solution and 40 ml of the stock tank water, the fixing tank was refilled with 10 ml of the concentrated fixing solution and 30 ml of the stock tank water, and the washing tank was refilled with 60 ml of the stock tank water from the cleaning tank. A running processing of 15 sheets of the light-sensitive materials a day continued. Whenever the developing solution, the fixing solution, and water were consumed during this period, new refilling solutions were added similarly.

The running processing lasted 2 months. However, the initial photographic properties were maintained. Furthermore, there was no mineral deposit formed in the washing tank in spite of no renewal of water.

Furthermore, when an equimolar of a near infrared sensitizing dye of the structural formula A′ was used instead of the near infrared sensitizing dye of the structural formular A in this example, the same results were obtained.

Structural Formula A′

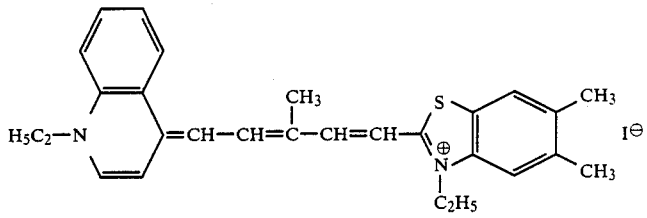

The system has the following advantages:

i. Even if a very small amount of wash water is used, no mineral deposit is generated, making maintenance such as cleaning of the roller and rack unnecessary.

ii. Since the processing can be made by the supply of a small amount of water, plumbing apparatus is unnecessary, making it possible to install an automatic developing machine anywhere.

iii. The stock tank for the developing and fixing solution is unnecessary. This reduces the installation space required for the automatic developing machine.

iv. Preparation of the developing and fixing solutions is unnecessary, making the operation easier.

v. Since the developing solution is stable, the photographic properties of sheets of light-sensitive materials which have been processed in the initial stage are stable.

vi. Since there is no generation of sulfite gas due to decomposition of thiosulfate, there is generated less oder of the fixing solution, providing a good working environment.

EXAMPLE 2

A developing solution and a fixing solution having the same compositions as in Example 1 were used. The wash water tank and the wash water stock tank were filled with an aqueous solution of 0.5 g/l of diethylenetriamine pentaacetic acid and 0.12 g/l of caustic soda. With this arrangement, Fuji Photo Film Co., Ltd., X-ray light-sensitive material HRA was subjected to a running experiment as described below using a Fuji Photo Film Co., Ltd., FPM 3000 Automatic Developing Machine. (This automatic developing machine was equipped with a squeeze roller cleaning tank, and pumps for supplying the developing solution, fixing solution, wash water, and diluting water.) (96-second dry-to-dry process)

| | | |
|---|---|---|
| Developing solution | 11.5 l | 35° C. × 25 sec. |
| Fixing solution | 6.5 l | 32° C. × 20 sec. |
| Washing water | 6 l | Flowing water × 14 sec. |
| Wash water stock tank | 40 l | |

-continued

| Daily processed amount | 60 sheets (quarter size) |
|---|---|

The running experiment lasted two months. The initial photographic properties were maintained. No algae was formed in the washing tank, thus providing a very easy maintenance.

EXAMPLE 3

As experiment was conducted in the same manner as in Example 2 except that as water for wash water and diluting water stock tanks there was used water having the below-mentioned properties which had been obtained by passing tap water through a mixed bed column filled with a Type H strong acid cation exchange resin (Mitsubishi Chemical Industries, Ltd., Diaion SK-1B) and a Type OH strong basic anion exchange resin (Mitsubishi Chemical Industries, Ltd., Diaion SA-10A).

| Stock Tank Solution | |
|---|---|
| Calcium ion | 1.1 mg/l |
| Magnesium ion | 0.5 mg/l |
| pH | 6.9 |

The running experiment lasted two months. The initial photographic properties were maintained. The maintenance was very easy.

EXAMPLE 4

A running experiment was conducted in the same manner as in Example 1 except that water containing the chelating agent was replaced by water which had been irradiated with ultraviolet rays from a Toshiba Corp., ultraviolet lamp GL-15 (wavelength: 254 nm) for 90 minutes in the water stock tank. After the running processing, excellent results were obtained as in Example 1.

COMPARATIVE EXAMPLE 1

A running experiment was conducted in the same manner as in Example 1 except that the water stock tank solution containing disodium ethylenediamine tetraacetate (dihydrate) was replaced by water containing 0.5 g/l of sodium hypochlorite and 0.5 g/l of sodium chlorinated isocyanurate, respectively.

However, algae was formed in the washing tank in two weeks and the developing solution deteriorated. The initial photographic properties lasted only one week.

These results show that antibacterial and antifungal means which have been heretofore known cannot be used in wash water and diluting water in any manner to obtain excellent effects. Only the limited process of the present invention can be applied and provide excellent effects.

The present invention provides the following effects:

(1) Preparation of the developing solution or fixing solution is unnecessary, making the operation easier.

(2) A prolonged running processing can be made without renewing diluting water or cleaning the diluting water stock tank.

(3) Since the concentrated solutions were diluted with water shortly before use, and a specified antifungal means is provided, the stability of the developing or fixing solution is excellent, giving no adverse effects on the photographic properties. Particularly, sheets of light-sensitive material which have been processed in the initial stage show stable photographic properties.

(4) It is made possible to stock diluting water in an automatic developing machine. This makes plumbing apparatus unnecessary, making it possible to install the automatic developing machine anywhere.

(5) The stock tanks for the developing solution or fixing solution itself are unnecessary. This reduces the installation space required by the automatic developing machine.

(6) The same water can be used commonly as wash water and diluting water. Therefore, even if water is sparingly used, no mineral deposit is formed, making maintenance such as cleaning of the roller and rack unnecessary.

While the invention has been described in detail and with reference to specific embodiments thereof, it will be apparent to one skilled in the art that various changes and modifications can be made therein without departing from the spirit and scope thereof.

What is claimed is:

1. A process for development, fixing, and washing or stabilization of a silver halide photographic light-sensitive material by means of an automatic developing machine, which process comprises:

(1) developing and/or fixing said photographic light sensitive material in a developing bath and/or a fixing bath supplied with:

(a) a concentrated developing solution and/or a concentrated solution having a fixing capacity, respectively, and (b) water which has been treated by at least one antifungal means selected from the group consisting of irradiation with ultraviolet rays, irradiation with magnetic fields, processing with ion exchange resins, and incorporation of at least one compound selected from the group consisting of aminopolycarboxylic acids and phosphonic acids, and (2) washing or stabilizing said silver halide photographic light-sensitive material with said water treated with antifungal means or with a combination of said water treated with antifungal means and/or wash water or a stabilizing solution, wherein the amount of washing water or stabilizing solution used is 3 1 or less (including 0 1) per 1 $m^2$ of said silver halide photographic light-sensitive material.

2. A process as claimed in claim 1, wherein said antifungal means is the incorporation of at least one compound selected from the group consisting of aminopolycarboxylic acids and phosphonic acids.

3. A process as claimed in claim 1, wherein said antifungal means is the irradiation with ultraviolet rays.

4. A process as claimed in claim 1, wherein said antifungal means is the irradiation with magnetic fields.

5. A process as claimed in claim 1, wherein said antifungal means is the processing with ion exchange resins.

6. A process as claimed in claim 2, wherein said aminopolycarboxylic acid or phosphoric acid is used in an amount of 0.02 to 20 g per liter of diluting water.

7. A process as claimed in claim 3, wherein said aminopolycarobxylic acid is selected from the group consisting of ethylenediamine tetraacetic acid (EDTA) diethylenetriamine pentaacetic acid, ethylenediamine-N-hydroxyethyl-N,N',N'-triacetic acid, propylenediamine tetraacetic acid, and triethylenetetramine hexaacetic acid and said phosphonic acid is selected from the group consisting of ethylenediaminetetramethylenephosphonic acid, 1-hydroxyethylidene-1,1-diphosphonic acid, and sodium, potassium, and ammonium salts thereof.

8. A process as claimed in claim 1, wherein said concentrated developing solution consists of a single agent solution.

9. A process as claimed in claim 1, wherein said concentrated developing solution contains a 3-pyrazolidone.

10. A process as claimed in claim 9, wherein said 3-pyrazolidone is a 4-substituted 3-pyrazolidone.

11. A process as claimed in claim 1, wherein said concentrated solution having a fixing capacity consists of a single agent solution.

12. A process as claimed in claim 11, wherein the fixing solution does not contain an aluminium hardener.

13. A process as claimed in claim 1, wherein the amount of washing water or stabilizing solution used is 0 to 2 l per $m^2$ of said silver halide photographic light-sensitive material.

14. A process as claimed in claim 1, wherein said concentrated developing solution does not contain a film hardener.

* * * * *